US007222447B2

(12) United States Patent
Maier-Hunke

(10) Patent No.: US 7,222,447 B2
(45) Date of Patent: May 29, 2007

(54) STAND FOR A REVOLVING CARD INDEX

(75) Inventor: Horst-Werner Maier-Hunke, Iserlohn (DE)

(73) Assignee: "Durable" Hunke & Jochheim & Co. KG, Iserlohn (DE)

( * ) Notice: Subject to any disclaimer, the term of this patent is extended or adjusted under 35 U.S.C. 154(b) by 68 days.

(21) Appl. No.: 10/487,571

(22) PCT Filed: Oct. 18, 2002

(86) PCT No.: PCT/DE02/04005

§ 371 (c)(1),
(2), (4) Date: Feb. 20, 2004

(87) PCT Pub. No.: WO03/037647

PCT Pub. Date: May 8, 2003

(65) Prior Publication Data

US 2004/0205990 A1 Oct. 21, 2004

(30) Foreign Application Priority Data

Oct. 23, 2001 (DE) ..... 101 53 117

(51) Int. Cl.
*A47B 49/00* (2006.01)

(52) U.S. Cl. ..... 40/377; 40/379

(58) Field of Classification Search ..... 40/377, 40/378, 379, 493, 506
See application file for complete search history.

(56) References Cited

U.S. PATENT DOCUMENTS 2,589,383 A * 3/1952 Holt ..... 40/379
2,703,744 A * 3/1955 Karper ..... 312/189
3,628,269 A * 12/1971 Dalh, Jr. ..... 40/379
3,890,727 A * 6/1975 Rose ..... 40/379
4,599,815 A 7/1986 Waldo

* cited by examiner

*Primary Examiner*—Gary C. Hoge
(74) *Attorney, Agent, or Firm*—Mark P. Stone

(57) ABSTRACT

A stand for a revolving card index is formed from parts which are fitted together to enable the economic manufacture of the stand.

24 Claims, 4 Drawing Sheets

STAND FOR A REVOLVING CARD INDEX

BACKGROUND OF THE INVENTION

The invention relates to a stand for a revolving card index having a roller-like holder for sheet-like information carriers which has two encircling T-shaped profile ridges serving for receiving the information carriers, in which rotational movements can be initiated by hand wheels, and which can be fixed in different angle positions by latching elements.

A stand of the abovementioned type which forms a constituent part of a revolving card index which is sold throughout the world under the "ROLODEX" trademark is known. The known stand comprises a tube which has been bent a number of times, a shaft which is flattened on one side being mounted in a rotatable manner in the mutually parallel ends of said tube. The shaft bears two plastic bodies which are guided thereon such that they can be displaced in the direction of its longitudinal axis, which form the roller-like holder and which are secured against axial movements relative to one another by the information carriers. Arranged at the flattened tube ends, moreover, are cup-like abutments which have end surfaces directed toward the hand wheels fastened at the ends of the shaft. Located between one of these end surfaces and one of the band wheels is a latching mechanism which has steel balls subjected to the action of a spring force, and which is intended for fixing the holder in different positions.

On account of the large number of parts and the design thereof, the construction of the known stand is comparatively complex and thus costly. In addition, the axial displaceability of the holder on the steel shaft which bears it is not fully satisfactory. This is because, if the known revolving card index is used over a relatively long period of time, on account of friction between the borders of the cup-like abutments and the lateral edges of the information carriers, this displaceability may result in undesired wear marks on the information carriers.

BRIEF SUMMARY OF THE INVENTION

The object of the invention is to provide a stand of the type in question which is distinguished by a straightforward and cost-effective construction and in which the holder cannot execute any axial movement in relation to the supports which bear it. This object is achieved according to the invention in that the holder comprises two parts which are connected to one another by coupling elements to form a unit and, at their ends which are directed away from the coupling location, are designed as bearing journals which are guided in a respective support and are secured against axial displacements in relation to said support.

In the case of the stand according to the invention, the roller-like holder serves simultaneously as a holder and as a shaft, with the result that axial relative movements between it and a separate shaft bearing it are ruled out and there is thus no possibility of any undesirable frictional contact between the edges of the information carriers and the supports.

It appears to be particularly advantageous if, on their end sides, the bearing journals have retaining tongues which are provided with latching noses which engage behind latching stops in the interior of the hand wheels. The latching connection allows quick assembly of the hand wheels, supports and holder.

Further features and details of the invention can be gathered from the subclaims and the following description of a particularly advantageous embodiment of the invention illustrated in the attached drawing.

DETAILED DESCRIPTION OF THE INVENTION

Figure 1:
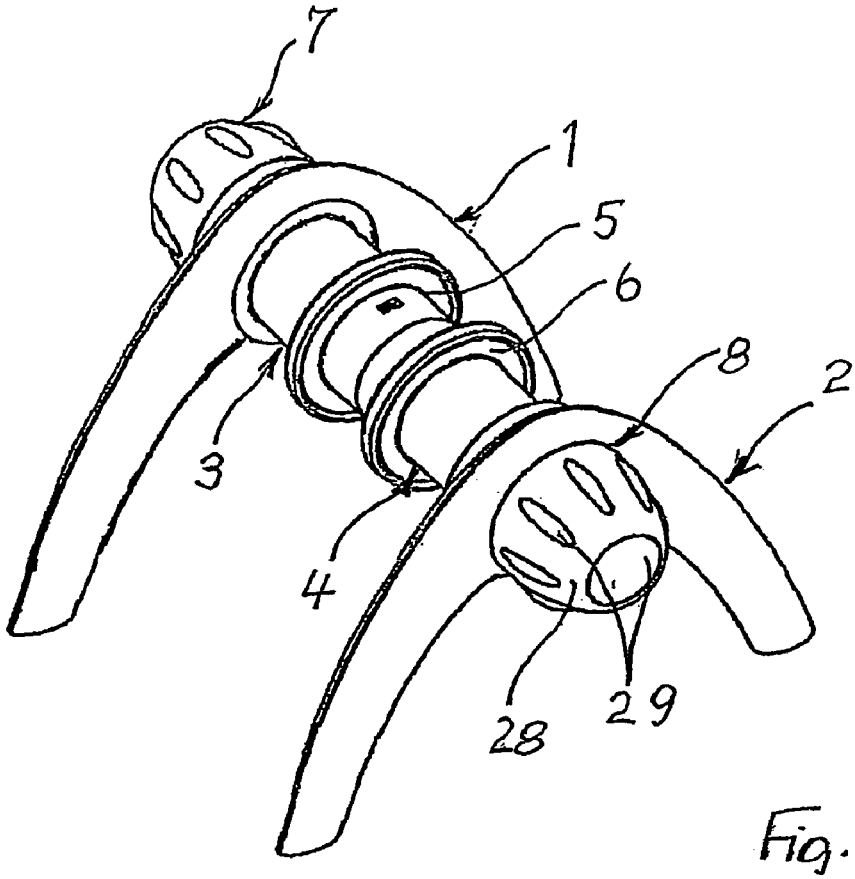
FIG. 1 shows the perspective view of a stand for a revolving card index.
Figure 2:
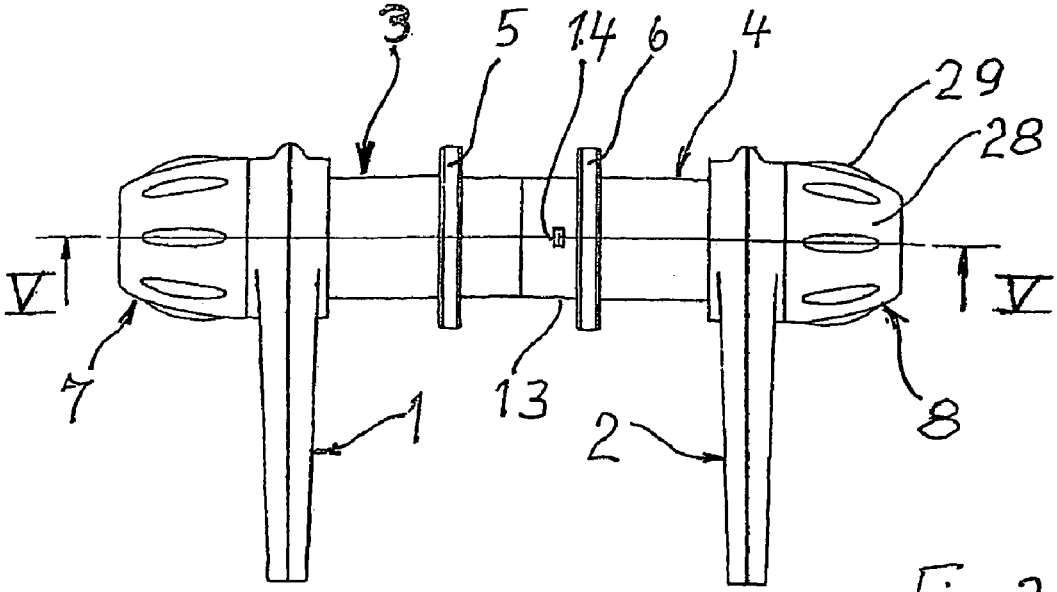
FIG. 2 shows a side view of the stand according to FIG. 1.
Figure 3:
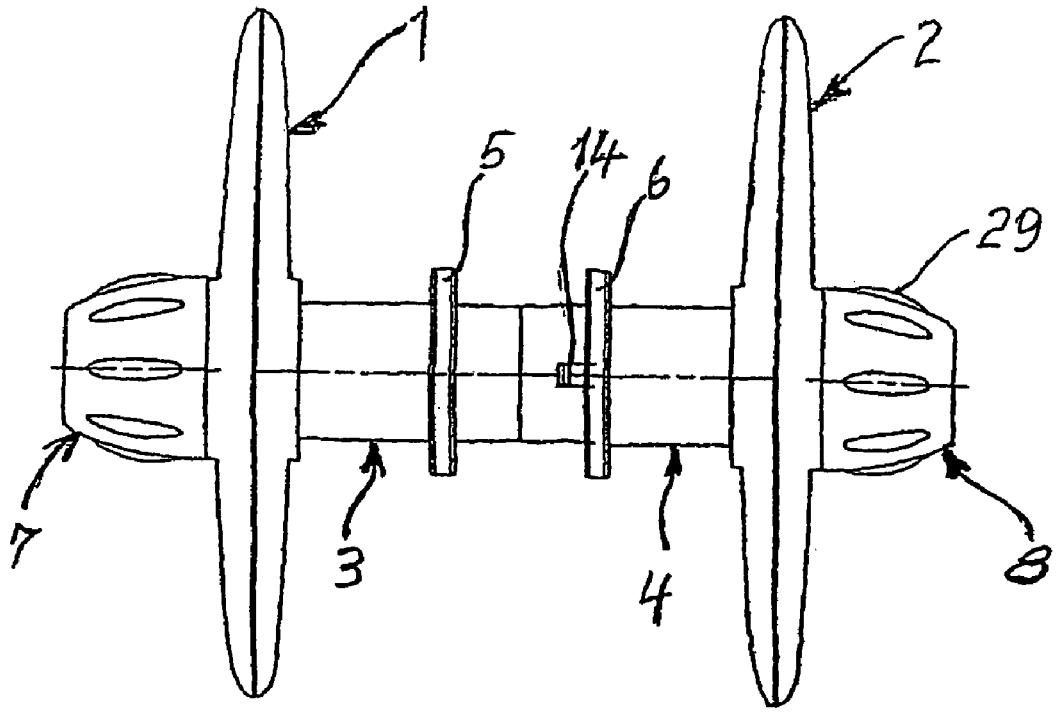
FIG. 3 shows a plan view of the stand according to FIG. 1.
Figure 4:
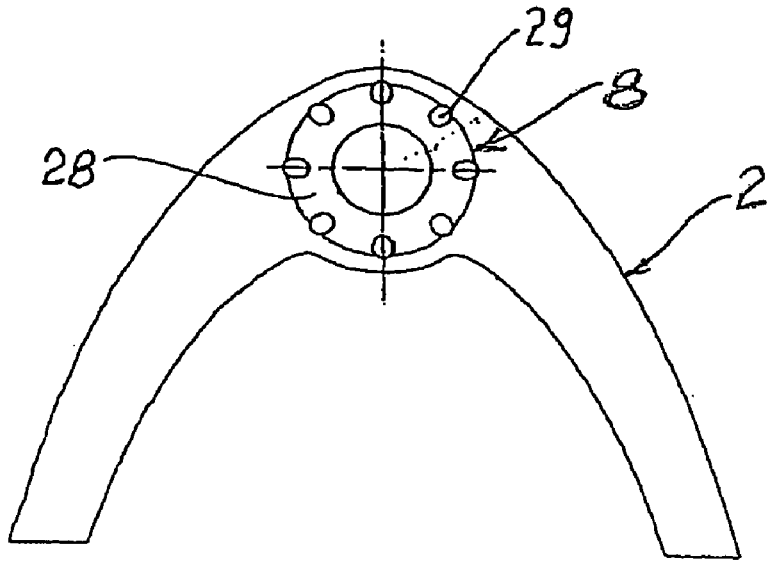
FIG. 4 shows an end view of the stand according to FIG. 1.

The stand illustrated in the figures has two supports 1 and 2, in which is mounted in a rotatable manner a roller-like holder which comprises two identical parts 3 and 4 connected to one another by coupling elements and which is intended for sheet-like information carriers (not illustrated in the drawing). On their bottom border, the information carriers have T-shaped recesses, with the aid of which they can be anchored on encircling T-shaped profile ridges 5, 6 of the holder 3, 4. Two hand wheels 7, 8 serve for initiating a rotational movement in the holder 3, 4.

Details of the construction of the stand can be gathered from FIGS. 5 to 10. It can be seen from the sectional illustration according to FIG. 5 that the parts 3 and 4, which are designed as hollow plastic injection moldings, partially overlap in the central region of the holder. Each of the two parts 3 and 4—as explained with reference to part 4—has, in the coupling region, a half-shell 9 which can be introduced into a likewise half-shell-like recess 10 in the interior of the respectively other part 3 or 4.

Two latching noses 11, 12 on the circumference of each half-shell 9, said latching noses being offset through 90° in relation to one another, are assigned latching holes 13, 14 on the respectively other part 3 or 4 of the holder, said latching holes likewise being offset through 90° in relation to one another. In other words, the parts 3 and 4 are held together by a plug-in connection designed in the manner of a snap-action closure.

At their ends which are directed away from the plug-in connection, the parts 3 and 4 are provided with bearing journals 15, by means of which they are mounted in the vertex of the supports 1, 2, the length of the bearing journals 15 being essentially equal to the width of the supports 1, 2 in the bearing zone. The diameter of the bearing journals is smaller than the diameter of the parts 3, 4 forming the remainder of the roller-like holder. Projecting beyond the end sides 16 of the bearing journals 15 are pairs of retaining tongues 17, 18 and likewise pairs of pins 19, 20. The retaining tongues 17, 18 have latching noses 21, 22, which engage behind latching stops 23, 24 in the interior of the basic body 25 of in each case one of the two hand wheels 7, 8, which, like the supports 1, 2 and the parts 3, 4, are identical. The pins 19, 20, which are not absolutely necessary, are assigned bores 26, 27 in the basic body 25. The identical design of the parts 1, 2, 3, 4, 7 and 8, which are advantageously designed as plastic injection moldings, makes it possible to keep the tooling costs low, and the abovedescribed plug-in or latching connections make it possible to keep the assembly costs low.

In order for it to be possible to dismantle the parts again if need be, the retaining tongues 17, 18 are accessible from the outside of the hand wheels 7, 8. The accessibility is achieved in that the basic body 25 of each hand wheel is assigned a covering cap, which comprises a dimensionally stable, cage-like outer shell 28 and a soft/resilient inset 29.

Figure 5:
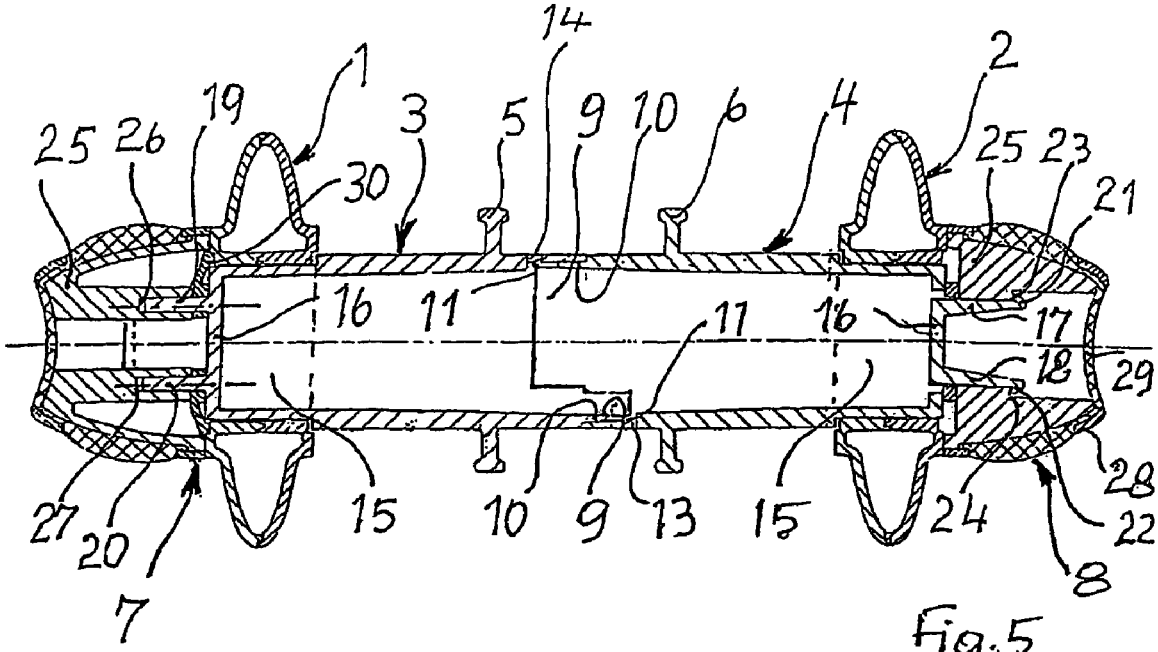
FIG. 5 shows a section along line V—V in FIG. 2.
Figure 6:
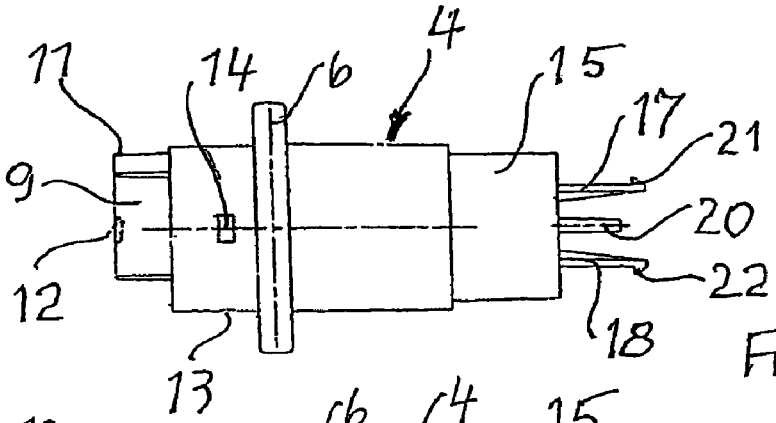
FIG. 6 shows a first side view of one of the two parts which form the holder which can be seen in FIGS. 1 to 5 and is intended for sheet-like information carriers.
Figure 7:
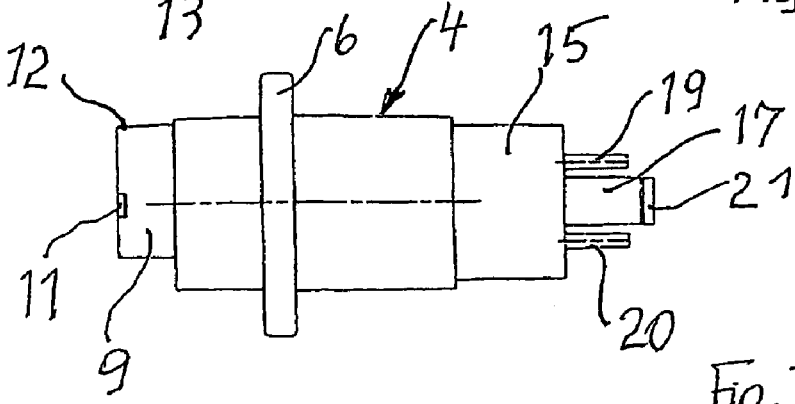
FIG. 7 shows the part shown in FIG. 6, in a position in which it has been rotated through 180°.
Figure 8:
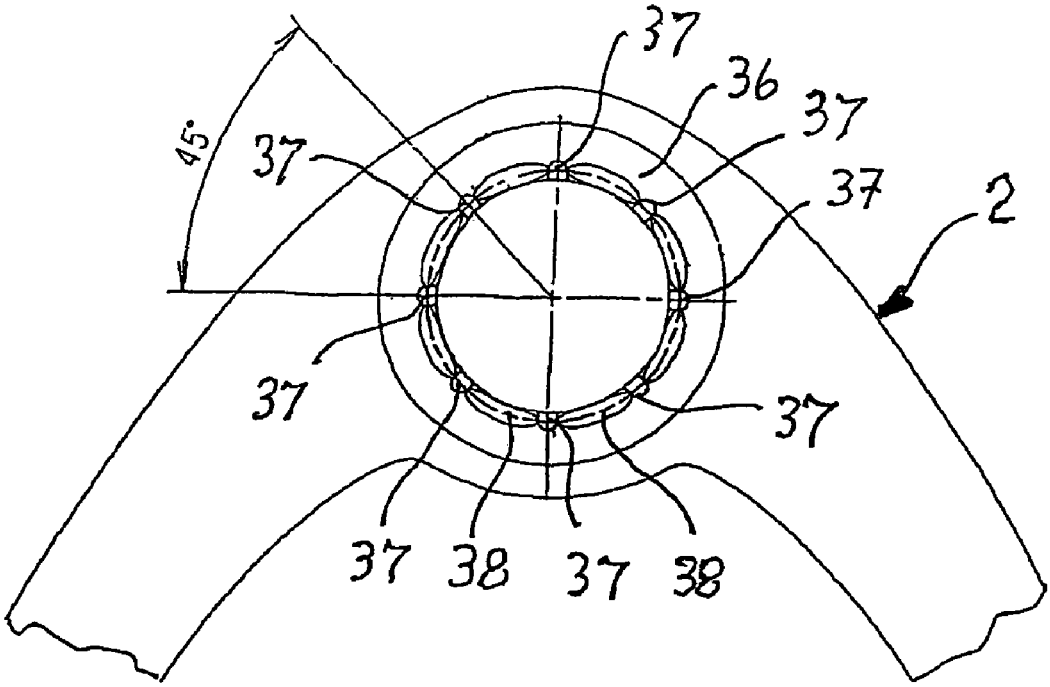
FIG. 8 shows the end view of the vertex of a support of the stand according to FIGS. 1 to 7.
Figure 9:
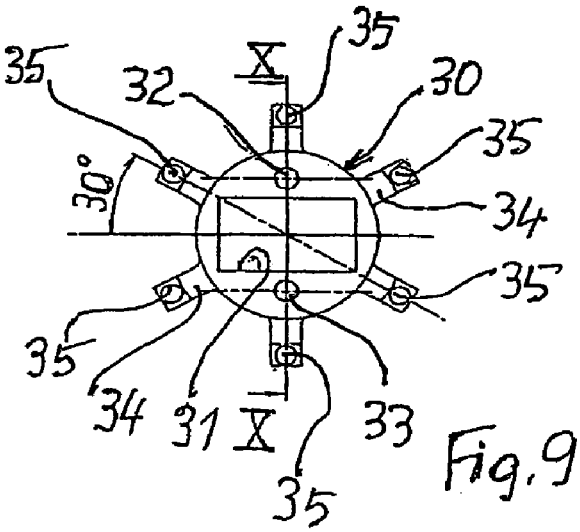
FIG. 9 shows a latching disk for the latching mechanism for fixing the holder of the stand in different angle positions.
Figure 10:
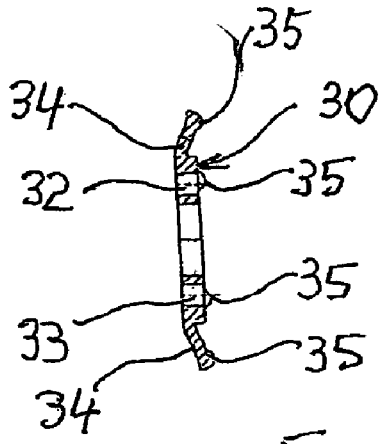
FIG. 10 shows a section through the latching disk according to FIG. 9, along line X—X in FIG. 9.

A latching disk 30 is arranged between the hand wheel 7, which is on the left in FIG. 5, and the end side 16 of the bearing journal 15 of the part 3 of the shaft-like holder 3, 4, and the construction of said latching disk can be gathered from FIGS. 9 and 10. In the region of its disk-shaped main part, the latching disk 30 has a cutout 31 for the retaining tongues 17, 18 and bores 32, 33 for the pins 19, 20. Projecting over the circumference of the main part are six extension arms 34, which are provided with hemispherical latching protrusions 35 at their free end. Arranged on the end surface 36 of the support 1, said end surface being directed toward the latching protrusions 35, are eight latching hollows 37, between which are located guide grooves 38 with a depth which decreases toward their ends, with narrow crosspieces being formed in the process. Two latching protrusions 35 of the latching disk 30 and two latching hollows 37 on the end surface 36 of the support 1 are located diametrically opposite one another in each case and engage with another in pairs in each case in order to fix the holder 3, 4 in different angle positions. Since the respectively successive latching hollows 37 are spaced apart from one another by an angular distance of 45°, while the angular distance between in each case two successive latching protrusions 35 is 60° in each case, the pairs of latching protrusions latch into associated pairs of latching hollows twenty-four times during a revolution of the hand wheels 7, 8.

The invention claimed is:

1. A stand for a revolving card index having a roller-like holder for sheet-like information carriers, said holder comprising two parts which overlap partially in a region where said two parts are connected to one another, each of said two parts being provided with an encircling T-shaped profile ridge (5, 6) for receiving the information carriers, hand wheels for initiating rotational movement of said holder, and means for keeping said holder in different angular positions, the stand further having two supports which at their upper ends are provided with apertures forming bearing bushings for receiving bearing journals (15), characterized in that said bearing journals are formed by those ends of each of said two parts of the holder remote from said region.

2. The stand as claimed in claim 1, characterized in that the bearing journals (15), on end sides (16) thereof, are provided with pins (19, 20) which can be introduced into bores (26, 27) of the hand wheels (7, 8).

3. The stand as claimed in claim 1, characterized in that the supports (1, 2) are essentially V-shaped with the apertures forming the bearing bushings for the bearing journals (15) being arranged in the region of the vertex of the supports in each case.

4. The stand as claimed in claim 1, characterized in that the parts (3, 4) forming the holder are connected to one another in the overlapping region by latching noses (11, 12) engaging in latching holes (13, 14).

5. A stand as claimed in claim 1, characterized in that the diameter of the bearing journals (15) is smaller than the diameter of the rest of the roller-like holder.

6. A stand as claimed in claim 1, characterized in that the length of the bearing journals (15) is essentially equal to the width of the supports (1, 2).

7. A stand as claimed in claim 1, characterized in that the two parts (3, 4) at their ends directed away from the location at which they are connected to one another are provided with end sides (16).

8. A stand for a revolving card index having two supports (1, 2) for the ends of a roller-like holder for sheet-like information carriers, said holder comprising two parts which overlap partially in a region where said two parts are connected to one another, each of said two parts being provided with an encircling profile ridge for receiving the information carriers, hand wheels for initiating rotational movement of said holder, and latching elements for fixing said holder in different angular positions, characterized in that the encircling profile ridges have a T-shaped profile and that the two parts (3, 4) of the holder are connected to one another by coupling elements to form a unit which at the ends of said unit directed away from the location at which said two parts are connected to one another forms bearing journals (15) which are guided in said supports (1, 2) and which secure the holder against axial displacements in relation to said supports (1, 2), characterized in that, the bearing journals (15), on end sides (16) thereof, have retaining tongues (17, 18) which are provided with latching noses (21, 22) which engage behind latching stops in the interior of the hand wheels (7, 8).

9. The stand as claimed in claim 8, characterized in that the latching noses (21, 22) of the retaining tongues (17, 18) and the latching stops (23, 24) of the hand wheels (7, 8) are accessible from the outside of the hand wheels (7, 8).

10. The stand as claimed in claim 9, characterized in that the hand wheels (7, 8) have a basic body (25) and a covering cap.

11. The stand as claimed in claim 10, characterized in that the covering cap comprises an outer shell (28) and an insert (29).

12. The stand as claimed in claim 8, characterized in that, the bearing journals (15), on end sides (16) thereof, are provided with pins (19, 20) which can be introduced into bores (26, 27) of the hand wheels (7, 8).

13. A stand for a revolving card index having two supports (1, 2) for the ends of a roller-like holder for sheet-like information carriers, said holder comprising two parts which overlap partially in a region where said two parts are connected to one another, each of said two parts being provided with an encircling profile ridge for receiving the information carriers, hand wheels for initiating rotational movement of said holder, and latching elements for fixing said holder in different angular positions, characterized in that the encircling profile ridges have a T-shaped profile and that the two parts (3, 4) of the holder are connected to one another by coupling elements to form a unit which at the ends of said unit directed away from the location at which said two parts are connected to one another forms bearing journals (15) which are guided in said supports (1, 2) and which secure the holder against axial displacements in relation to said supports (1, 2), characterized in that a latching disk (30), which is connected in a rotationally fixed manner to the holder (3, 4), is arranged between at least one of said hand wheels (7) and an annular end surface (36) of one of said supports (1), which encloses one of said bearing journals (15).

14. The stand as claimed in claim 13, characterized in that the latching disk (30) is provided with a cutout (31) for retaining tongues (17, 18) for the bearing journals (15) and with bores (32, 33) for pins (19, 20) provided on the bearing journals (15).

15. The stand as claimed in claim 14, characterized in that the latching disk (30) is provided with resilient extension arms (34) which have essentially hemispherical latching protrusions (35) at free ends of said resilient extension arms.

16. The stand as claimed in claim 13, characterized in that the latching disk (30) is provided with resilient extension arms (34) which have essentially hemispherical latching protrusions (35) at free ends of said resilient extension arms.

17. The stand as claimed in claim 16, characterized in that latching hollows (37) for the latching protrusions (35) are arranged on the end surface (36) of said one support (1), which encloses the bearing journal (15), said end surface being directed toward the latching disk (30).

18. The stand as claimed in claim 17, characterized in that provided between in each case two of said successive latching hollows (37) is a guide groove (38) for said latching protrusions (35) which are not latched in said latching hollows (37).

19. The stand as claimed in claim 18, characterized in that in each case two said latching protrusions (35) of the latching disk (30) and in each case two said latching hollows (37) on the end surface (36) of the support (1) are located diametrically opposite one another.

20. The stand as claimed in claim 17, characterized in that in each case two of said latching protrusions (35) of the latching disk (30) and in each case two said latching hollows (37) on the end surface (36) of said one support (1) are located diametrically opposite one another.

21. The stand as claimed in claim 17, characterized in that the number of said latching hollows (37) is greater than the number of said latching protrusions (35).

22. The stand as claimed in claim 21, characterized in that eight said latching hollows (37), which are distributed uniformly over the circumference of the annular end surface (36) of said one support (1), said end surface enclosing the bearing journal (15), are assigned six said latching protrusions (35), which are distributed uniformly over the circumference of the latching disk (30).

23. The stand as claimed in claim 13, characterized in that the parts (3, 4) forming the holder, the supports (1, 2), the latching disk (30) and the hand wheels (7, 8) are designed as plastic parts which can be plugged together.

24. A stand for a revolving card index having two supports for the ends of a roller-like holder for sheet-like information carriers, said holder comprising two parts which overlap partially in a region where said two parts are connected to one another, each of said two parts being provided with an encircling profile ridge for receiving the information carriers, said stand further comprising hand wheels for initiating rotational movement of said holder, and latching elements for fixing said holder in different angular positions, characterized in that the encircling profile ridges have a T-shaped profile and that the two parts (3, 4) of the holder form a unit at the ends of which directed away from the location at which said two parts are connected to one another forms bearing journals (15) which are guided in said supports (1, 2), said bearing journals (15), on end sides (16) thereof, have retaining tongues (17, 18) which are provided with latching noses (21, 22) which engage behind latching stops in the interior of the hand wheels (7, 8).

* * * * *